US010041373B2

(12) United States Patent
Vela et al.

(10) Patent No.: US 10,041,373 B2
(45) Date of Patent: Aug. 7, 2018

(54) GAS TURBINE WATER WASH METHODS AND SYSTEMS

(71) Applicant: General Electric Company, Schenectady, NY (US)

(72) Inventors: Veronica Elizabeth Vela, Queretaro (MX); Berenice Vilchis, Queraturo (MX); Yeremi Adair Lopez, Queretaro (MX); Salvador Villarreal, Queretaro (MX)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 14/985,799

(22) Filed: Dec. 31, 2015

(65) Prior Publication Data

US 2017/0191375 A1 Jul. 6, 2017

(51) Int. Cl.
*B08B 9/00* (2006.01)
*F01D 25/00* (2006.01)
(Continued)

(52) U.S. Cl.
CPC ..... *F01D 25/002* (2013.01); *B08B 9/093* (2013.01); *F01D 21/003* (2013.01); *F04D 27/001* (2013.01); *F05D 2220/32* (2013.01); *F05D 2260/80* (2013.01); *F05D 2270/30* (2013.01); *F05D 2270/303* (2013.01); *F05D 2270/54* (2013.01)

(58) Field of Classification Search
None
See application file for complete search history.

(56) References Cited

U.S. PATENT DOCUMENTS

2005/0096832 A1 5/2005 Takada et al.
2013/0186435 A1* 7/2013 Saha ..... F01D 25/002 134/36
2015/0135727 A1* 5/2015 Chillar ..... F01D 25/002 60/801

FOREIGN PATENT DOCUMENTS

EP 2876263 A1 * 5/2015 ..... F01D 25/002

OTHER PUBLICATIONS

Schepers, W. et al., "Optimization of On-line and Off-line washing at a 26-MW-gas turbine under special consideration of increase in power," VGB Kraftwerkstechnik, vol. 79, No. 3, pp. 46-54, (Jan. 1999), 23 total pages.

(Continued)

*Primary Examiner* — Eric W Golightly
(74) *Attorney, Agent, or Firm* — Fletcher Yoder, P.C.

(57) ABSTRACT

A control system for a gas turbine includes a controller. The controller includes a processor configured to access an operational parameter associated with the gas turbine. The processor is configured to receive a plurality of signals from sensors disposed in a turbine system, wherein the turbine system comprises a compressor system. The processor is further configured to derive a compressor efficiency and a turbine heat rate based on the plurality of signals. The processor is additionally configured to determine if an online water wash, an offline water wash, or a combination thereof, should be executed. If the processor determines that the online water wash, the offline water wash, or the combination thereof, should be executed, then the processor is configured to execute the online water wash, the offline water wash, or the combination thereof.

17 Claims, 3 Drawing Sheets

(51) Int. Cl.

| | |
|---|---|
| ***B08B 9/093*** | (2006.01) |
| ***F01D 21/00*** | (2006.01) |
| ***F04D 27/00*** | (2006.01) |

(56) References Cited

OTHER PUBLICATIONS

Extended European Search Report and Opinion issued in connection with corresponding EP Application No. 16205239.3 dated May 4, 2017.

* cited by examiner

GAS TURBINE WATER WASH METHODS AND SYSTEMS

BACKGROUND

The subject matter disclosed herein relates to gas turbines, and more particularly, to improving water wash methods and systems for gas turbines.

Gas turbine systems typically include a compressor for compressing a working fluid, such as air. The compressed air is injected into a combustor which heats the fluid causing it to expand, and the expanded fluid is forced through a turbine. As the compressor consumes large quantities of air, small quantities of dust, aerosols and water pass through and deposit on the compressor (e.g., deposit onto blades of the compressor). These deposits may impede airflow through the compressor and degrade overall performance of the gas turbine system over time. Therefore, gas turbine engines may be periodically washed to clean and remove contaminants from the compressor; such operations are referred to as an offline wash operation or an online wash operation. The offline wash operation is performed while the gas turbine engine is shutdown. Contrarily, the on-line water wash operation allows the compressor wash to be performed while the engine is in operation, but degrades performance of the gas turbine system somewhat. There is a desire, therefore, for a water wash system that provides for more effective cleaning of turbine compressors, and improves water wash methods and systems.

BRIEF DESCRIPTION

Certain embodiments commensurate in scope with the originally claimed disclosure are summarized below. These embodiments are not intended to limit the scope of the claimed disclosure, but rather these embodiments are intended only to provide a brief summary of possible forms of the disclosure. Indeed, the disclosure may encompass a variety of forms that may be similar to or different from the embodiments set forth below.

In a first embodiment, a system includes a control system for a gas turbine including a controller. The processor is configured to receive a plurality of signals from sensors disposed in a turbine system, wherein the turbine system comprises a compressor system. The processor is further configured to derive a compressor efficiency and a turbine heat rate based on the plurality of signals. The processor is additionally configured to determine if an online water wash, an offline water wash, or a combination thereof, should be executed. If the processor determines that the online water wash, the offline water wash, or the combination thereof, should be executed, then the processor is configured to execute the online water wash, the offline water wash, or the combination thereof.

A second embodiment includes a non-transitory computer-readable medium having computer executable code stored thereon, the code having instructions to derive a compressor efficiency and a turbine heat rate based on the plurality of signals. The processor is additionally configured to determine if an online water wash, an offline water wash, or a combination thereof, should be executed. If the code determines that the online water wash, the offline water wash, or the combination thereof, should be executed, then the code is configured to execute the online water wash, the offline water wash, or the combination thereof.

In a third embodiment, a method for a gas turbine system includes receiving a plurality of signals from sensors disposed in a turbine system, wherein the turbine system comprises a compressor system. The method further includes deriving a compressor efficiency and a turbine heat rate based on the plurality of signals. The method also includes determining if an online water wash, an offline water wash, or a combination thereof, should be executed; and, if it is determined that the online water wash, the offline water wash, or the combination thereof, should be executed, then executing the online water wash, the offline water wash, or the combination thereof.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

The present disclosure is directed towards a system and method to control and to schedule both online and offline water wash systems of a compressor system on a gas turbine system. The compressor system may include a low pressure compressor (LPC) and a high pressure compressor (HPC). The system may include a controller for a gas turbine system or a computing device suitable for executing code or instructions. The controller may be configured to calculate an LPC adiabatic efficiency. The controller may be additionally configured to calculate an HPC adiabatic efficiency. The controller may be further configured to calculate and engine heat rate. The controller may then determine when a LPC/HPC online water wash is desired based on the LPC and HPC adiabatic efficiencies and on the engine heat rate. The controller may additionally determine when a LPC/HPC offline water wash is desired based on the LPC and HPC adiabatic efficiencies and on the engine heat rate. The controller may then save certain efficiencies (e.g., HPC, LPC adiabatic efficiencies) before and after the water wash(es) are performed, for further analysis and/or logging. By improving the water wash processes, the techniques described herein may increase turbine engine system efficiency, improve fuel consumption and reduce parts wear.

Figure 1:
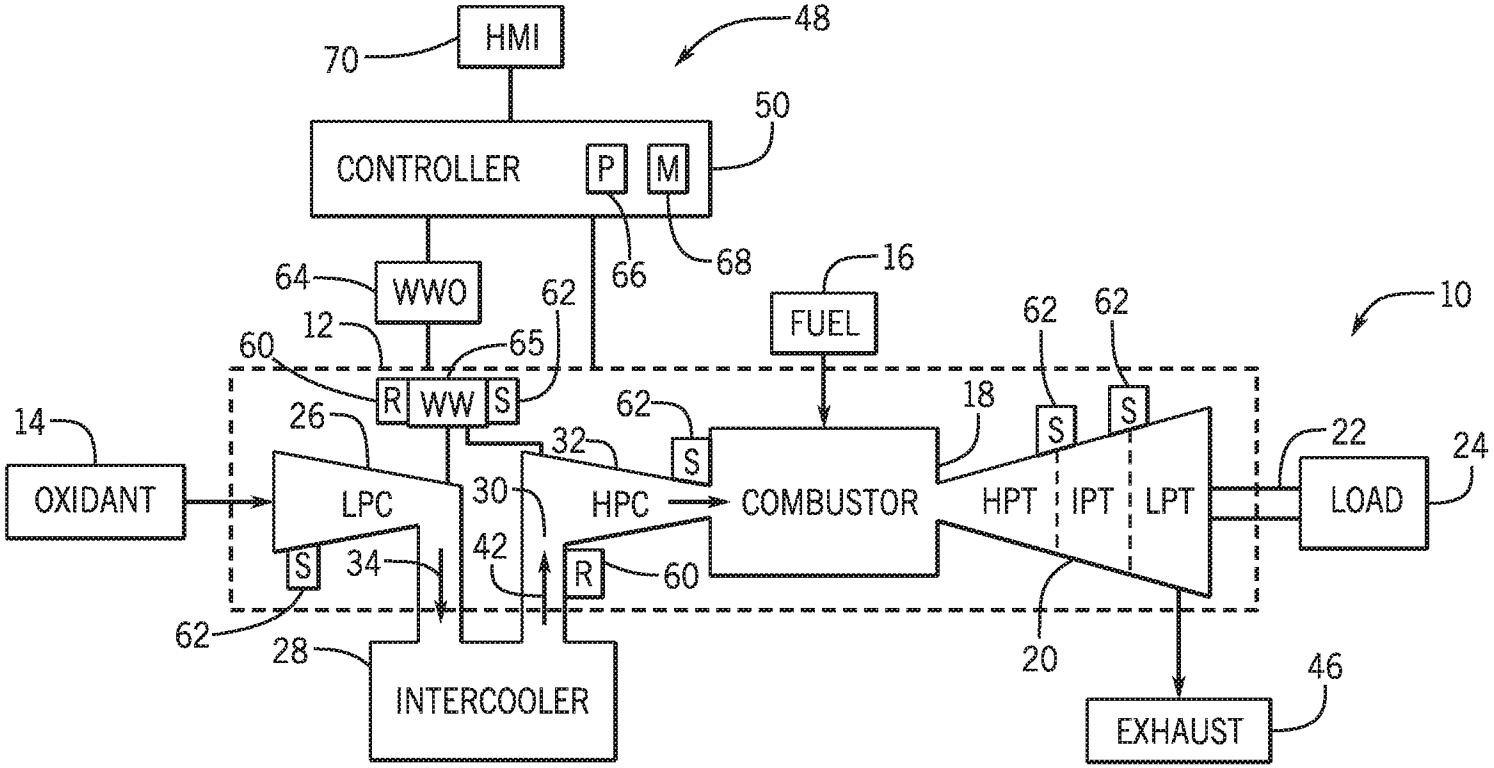
FIG. 1 is a schematic diagram of an embodiment of a power generation system having water wash system.

Turning to the figures, FIG. 1 is a schematic diagram of an embodiment of a power generation system 10 that includes a gas turbine system 12. The gas turbine system 12 may receive an oxidant 14 (e.g., air, oxygen, oxygen-enriched air, or oxygen-reduced air) and a fuel 16 (e.g., gaseous or liquid fuel), such as natural gas, syngas, or petroleum distillates. The oxidant 14 may be pressurized and combined with the fuel 16 to be combusted in a combustor 18. The combusted oxidant may then be used to apply forces to blades of a turbine 20 to rotate a shaft 22 that provides power to a load 24 (e.g., electric generator).

The gas turbine system 12 may include one or more compressors that increase the pressure of the oxidant 14. As depicted in FIG. 1, the gas turbine system 12 includes a lower pressure compressor (LPC) 26 connected to an intercooler 28 to couple the lower pressure compressor 26 to an inlet 30 of a high pressure compressor (HPC) 32. The oxidant 14 enters the low pressure compressor 26 and is compressed into a compressed oxidant 34 (e.g., gas, liquid, or both). The compressed oxidant 34 may include a compressed gas (e.g., air, oxygen, oxygen-enriched air, or oxygen-reduced air), a lubricant (e.g., oil), a coolant fluid, or any combination thereof. In certain embodiments, the compressed oxidant 34 may include gas from exhaust gas recirculation (EGR). The compressed oxidant 34 then enters the intercooler 28. It is to be noted that, in some embodiments of the system 10, no intercooler 28 is used.

The intercooler 28 may be any intercooler 28 suitable for cooling the compressed oxidant 34, such as a spray intercooler (SPRINT) or an efficient spray intercooler (ESPRINT). The intercooler 28 may cool the compressed oxidant 34 by using a fluid to increase the efficiency of the gas turbine system 12. The compressed and cooled oxidant 42 is further compressed in the high pressure compressor 32 and combined with the fuel 16 into an oxidant-fuel mixture to be combusted in the combustor 18. As the oxidant-fuel mixture is combusted (e.g., burned and/or ignited), the oxidant-fuel mixture expands through one or more turbines 20. For example, embodiments may include a high pressure turbine (HPT), intermediate pressure turbine (IPT), and a low pressure turbine (LPT) as depicted in FIG. 1. In some embodiments, the system 10 may include HPT and LPT turbines. In other embodiments, there may be a single turbine, four, five, or more turbines.

The turbine 20 may be coupled to a shaft 22 that is coupled to one or more loads 24. The turbine 20 may include one or more turbine blades that rotate causing the shaft 22 to provide rotational energy to the load 24. For example, the load 24 may include an electrical generator or a mechanical device in an industrial facility or power plant. The rotational energy of the shaft 22 may be used by the load 24 to generate electrical power. As the gas turbine system 12 generates power, the combusted oxidant-fuel mixture is expelled as an exhaust 46. The exhaust 46 may include one or more emissions, such as nitrogen oxides ($NO_x$), hydrocarbons (HC), carbon monoxide (CO) and/or other pollutants. The exhaust 46 may be treated in a variety of ways, such as with a catalyst system.

The power generation system 10 may also include a control system 48 to monitor and/or control various aspects of the gas turbine system 12, the load 24, and/or the intercooler 28. The control system 48 may include a controller 50 having inputs and/or outputs to receive and/or transmit signals to one or more actuators 60, sensors 62, or other controls to control the gas turbine system 12 and/or the intercooler 28. While some examples are illustrated in FIG. 1 and described below, these are merely examples and any suitable sensors and/or signals may be positioned on the gas turbine system 12, the load 24, and/or the intercooler 28 to detect operational parameters to control the power generation system 10 with the controller 50. For example, the controller 50 may send and/or receive a signal from one or more actuators 60 and sensors 62 to control any number of aspects of the system 10, including fuel supply, speed, oxidant delivery, power production, and so forth. For example, actuators 60 may include valves, positioners, pumps, and the like. The sensors 62 may sense temperature, pressure, speed, clearances (e.g., distance between a stationary and a moving component), flows, mass flows, and the like.

Further, the controller 50 may include and/or communicate with a water wash optimization system 64. The water wash optimization system 64 may calculate an LPC 26 adiabatic efficiency and an HPC 32 adiabatic efficiency, as well as an engine 12 heat rate. The water wash optimization system 64 may then determine when a LPC/HPC online water wash is desired based on the LPC and HPC adiabatic efficiencies and on the engine heat rate. The water wash optimization system 64 may additionally determine when a LPC/HPC offline water wash is desired based on the LPC and HPC adiabatic efficiencies and on the engine heat rate. The water wash optimization system 64 may then interface with a water wash system 65 to initiate a water wash process. The water wash system 65 may inject water and/or other fluids through the LPC 26 and/or HPC 32 to remove contaminants and build-up. The water wash optimization system 64 may then save certain efficiencies (e.g., HPC, LPC adiabatic efficiencies) before and after the water wash (es) are performed, for further analysis and/or logging. It is to be understood that the water wash optimization system 64 may be a software and/or hardware component of the controller 50, or may be a standalone system. For example, a computing device separate from the controller 50 may host the water wash optimization system 64.

The controller 50 may include a processor 66 or multiple processors, memory 68, and inputs and/or outputs to send and/or receive signals from the one or more sensors 62 and/or actuators 60. The processor 66 may be operatively coupled to the memory 68 to execute instructions for carrying out the presently disclosed techniques. These instructions may be encoded in programs or code stored in a tangible non-transitory computer-readable medium, such as the memory 68 and/or other storage. The processor 66 may be a general purpose processor, system-on-chip (SoC) device, or application-specific integrated circuit, or some other processor configuration. For example, the processor 66 may be part of an engine control unit that controls various aspects of the turbine system 12.

Memory 68 may include a computer readable medium, such as, without limitation, a hard disk drive, a solid state drive, a diskette, a flash drive, a compact disc, a digital video disc, random access memory (RAM), and/or any suitable storage device that enables processor 66 to store, retrieve, and/or execute instructions and/or data. Memory 68 may further include one or more local and/or remote storage devices. Further, the controller 50 may be operably connected to a human machine interface (HMI) 70 to allow an operator to read measurements, perform analysis, and/or adjust set points of operation.

Figure 2:
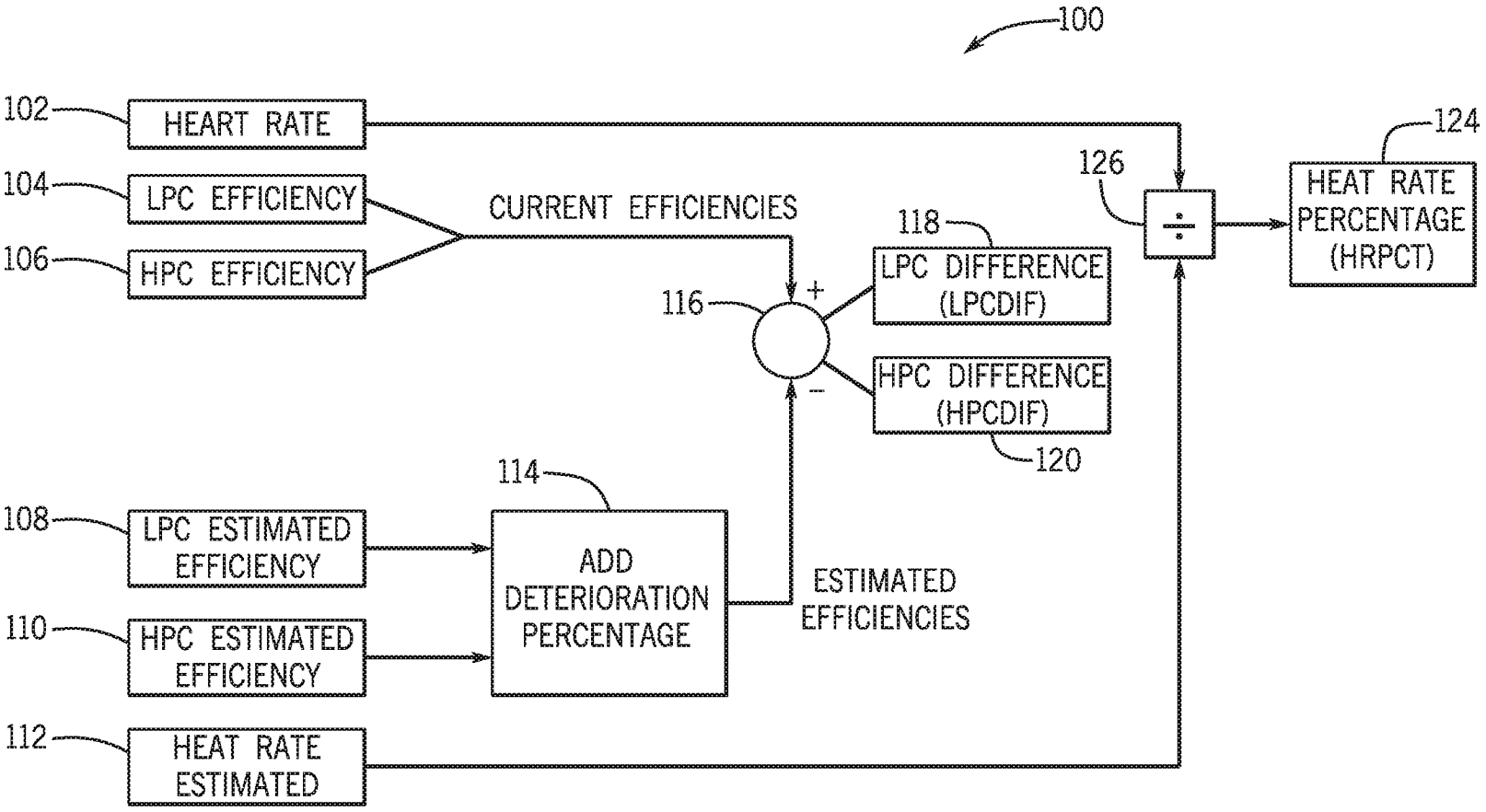
FIG. 2 is a flowchart of a process suitable for deriving certain efficiencies and a heat rate.

Turning now to FIG. 2, the figure illustrates and example of a process 100 suitable for deriving certain LPC and heat rate parameters. The LPC and heat rate parameters may then be used, for example, to determine a desired time to perform an online and/or an offline water wash. The process 100 may be implemented as computer code or instructions executable by the processor 66 and stored in memory 68. In the depicted embodiment, the process 100 may first derive, for example, in real time, a heat rate 102, a LPC efficiency (e.g., adiabatic efficiency) 104, and an HPC efficiency (e.g., adiabatic efficiency) 106. The process 100 may receive signals or data from the sensors 62 representative of pressures, temperatures, flows, mass flows, and the like. In one example, to calculate heat rate, the following equation may be used:

Heat rate (e.g., gas turbine heat rate)=Input Energy (BTU/hr)/Output power (kW).

Heat rate may be the inverse of efficiency.

In one example, to calculate adiabatic efficiency for a compressor (e.g., LPC and/or HPC), the following formula may be used:

$$\text{Adiabatic efficiency}=T_s[P_d/P_s)^{(k-1)/k}-1]/(T_d-T_s)$$

where $T_s$=suction temperature, $T_d$=discharge temperature and k is a ratio of specific heats, $C_p/C_v$. $C_p$ is constant pressure and $C_v$ is constant value.

The process 100 may additionally derive certain estimated LPC efficiency 108, estimated HPC efficiency 110, and estimated Heat Rate 112. The estimated LPC efficiency 108, estimated HPC efficiency 110, and estimated Heat Rate 112 may be derived, in one embodiment, by using a statistical model of a system 10 and/or system 10 components (e.g., gas turbine 12). The statistical model may uses statistical methods (e.g., linear regression, non-linear regression), data mining, and the like, to analyze historical data of a fleet of system 10 and/or system 10 components (e.g., gas turbines 12) to derive, given current sensor readings (e.g., pressures, temperatures, flows, mass flows, and the like) based on historical data. That is, rather than using only the sensor 62 readings and the equations listed above for heat rate and adiabatic efficiency, the process 100 may additionally use historical data gathered via a fleet of systems 10 and/or system 10 components (e.g., gas turbines 12) to derive what estimated or expected parameters 108, 110, and 112 should be.

The process 100 may then apply a deterioration percentage (block 114) to the LPC estimated efficiency 108 and to the HPC estimated efficiency 110. The deterioration percentage (block 114) may apply, for example, number of fired hours for the gas turbine 12 to estimate a percentage deterioration for the system 10 and/or system 10 components (e.g., gas turbine 12). In other words, a specific power system 10 may no longer operate in a pristine condition due to use, so block 114 may derate or otherwise add a deterioration factor to the LPC estimated efficiency 108 and to the HPC estimated efficiency 110 to improve accuracy. It is to be noted that in addition to or in lieu of fired hours, other measures such as number of start ups, shut downs, trips, overall power supplied, and so on, may be used by the block 114 to add a deterioration percentage.

A differentiator 116 may then take a difference between the LPC efficiency 104 and the LPC estimate efficiency 108 (with deterioration) to derive an LPC efficiency difference (LPCDIF) 118. Likewise, the differentiator 116 may then take a difference between the HPC efficiency 106 and the HPC estimate efficiency 110 (with deterioration) to derive an HPC efficiency difference (HPCDIF) 120. A heat rate percentage (HRPCT) 122 may be derived by dividing the heat rate 102 with the estimated heat rate 112, for example, via the divisor 124. In this manner, the process 100 may derive the LPC efficiency difference (LPCDIF) 118, the HPC efficiency difference (HPCDIF) 120, and the heat rate percentage (HRPCT) 122. A process 200 may then use the LPC efficiency difference (LPCDIF) 118, the HPC efficiency difference (HPCDIF) 120, and the heat rate percentage (HRPCT) 122, to derive a more optimal time for execution of an online and/or offline water wash, as described in more detail below with respect to FIG. 3.

Figure 3:
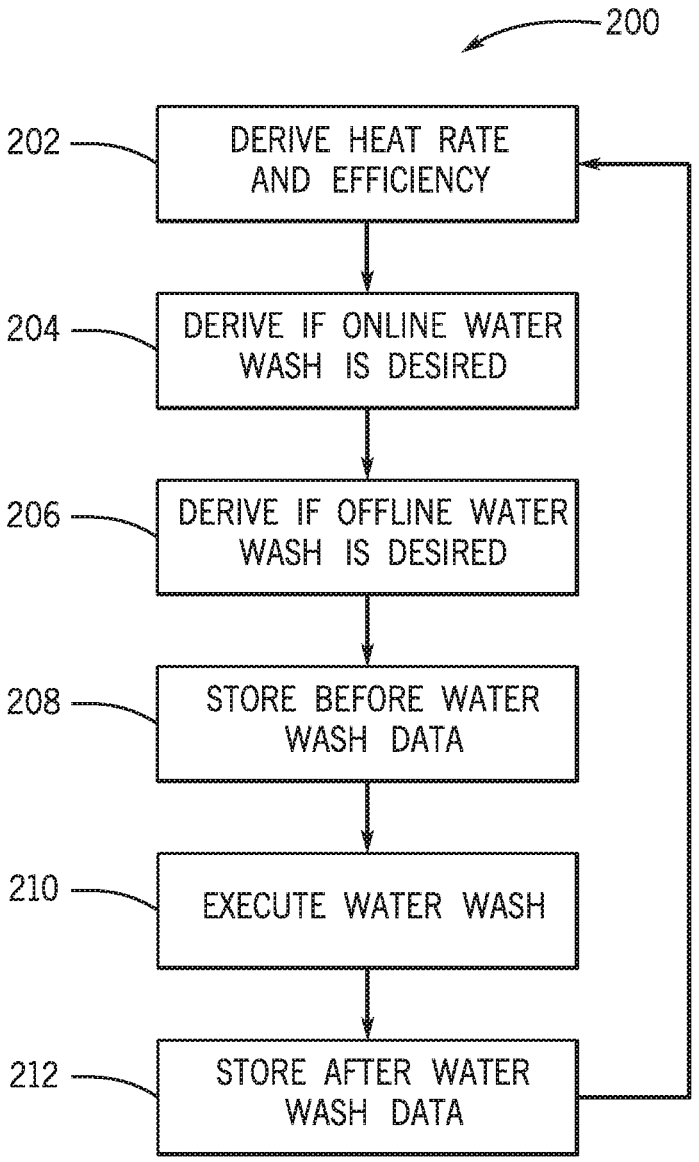
FIG. 3 is a flowchart of an embodiment of a process suitable for improving the use of the water wash system of FIG. 1.

FIG. 3 illustrates an embodiment of process 200 suitable for determining if an online and/or an offline water wash would improve operations of the power production system 10. The process 200 may be implemented as computer code or instructions executable by the processor 66 and stored in memory 68. In the depicted embodiment, the process 200 may derive a heat rate and certain efficiencies (block 202). For example, the block 202 may derive the LPC efficiency difference (LPCDIF) 118, the HPC efficiency difference (HPCDIF) 120, and the heat rate percentage (HRPCT) 122 by executing the process 100 described earlier.

The process 200 may then derive if an online water wash is desired (block 204), for example, based on the LPC efficiency difference (LPCDIF) 118, the HPC efficiency difference (HPCDIF) 120, and the heat rate percentage (HRPCT) 122. In one embodiment, if LPCDIF>0.01 and <=0.02 and HRPCT>0.01 and <=0.02 then an LPC online water wash is recommended. Likewise, if HPCDIF>0.01 and <=0.02 and HRPCT>0.01 and <=0.02 then an online HPC water wash is recommended. It is to be noted that while the block 204, in one embodiment, utilizes a range between >0.01 and <=0.02, in other embodiments, the range may be determined by an analysis process to derive a more optimal range based on gas turbine 12 type. For example, the range may be between >0.001 and <=0.10.

The process 200 may then derive if an offline water wash is desired (block 206), for example, based on the LPC efficiency difference (LPCDIF) 118, the HPC efficiency difference (HPCDIF) 120, and the heat rate percentage (HRPCT) 122. In one embodiment, if LPCDIF>0.02 and HRPCT>0.02 then a LPC offline water wash is recommend. Likewise, if HPCDIF>0.02 and HRPCT>0.02 then an offline HPC water wash is recommended. It is to be noted that while the block 206, in one embodiment, utilizes a value of >0.02, in other embodiments, the value may be determined by an analysis process to derive a more optimal range based on gas turbine 12 type. For example, the value may be >0.01.

Before initiating the online or the offline water wash, the process 200 may store certain before water wash data (block 208), for example in arrays. The before water wash data may include the LPC efficiency difference (LPCDIF) 118, the HPC efficiency difference (HPCDIF) 120, and/or the heat rate percentage (HRPCT) 122 previously calculated, as well as other data such as speed, pressure, flow, flow mass, temperature, and the like. Storing the before water wash data before initiating the water wash (block 208) may aid in tracking improvement measures in the power supply system 10, for example, due to executing the water wash.

The process 200 may then execute (block 210) either the online or the offline water wash. As mentioned above, the online water was may be performed while the gas turbine 12 is still operational, while the offline water wash may more comprehensively clean the compressor(s) while the gas turbine 12 is not running. The water wash may remove build up and impurities from the LPC and/or HPC and thus improve power production system 10 performance. Once the water wash is complete, the process 200 may store (block 212) certain after water wash data. The after water wash data may include LPC efficiency difference (LPCDIF) 118, the HPC efficiency difference (HPCDIF) 120, speed, pressure, flow, flow mass, temperature, and the like gathered after the water wash is complete. The after water wash data may then be compared to the before water wash data to gauge water wash efficiency, deterioration of equipment, and so on. The process 200 may then iterate back to block 202 and continue execution.

Technical effects of the present embodiments may include improving water wash systems and methods. In certain embodiments, a processor may receive one or more operational parameters of a turbine to derive compressor efficiencies and a gas turbine heat rate. The processor may then derive if an online water wash or an offline water wash is desired, for example, by using a range of values of the derived compressor efficiencies and heat rate. Before and after water wash data may be collected for further analysis and logging. By improving the time at which the water wash is to be executed, as opposed to using a fixed schedule, the techniques described herein may improve power production system efficiency while minimizing down time. The water wash may then be performed.

This written description uses examples to disclose the embodiments, including the best mode, and also to enable any person skilled in the art to practice the embodiments, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A control system for a gas turbine, comprising:

a controller comprising a processor, wherein the processor is configured to:

receive a plurality of signals from sensors disposed in a turbine system, wherein the turbine system comprises a compressor system, the compressor system comprising a low pressure compressor (LPC), a high pressure compressor (HPC), or a combination thereof;

derive a compressor efficiency and a turbine heat rate based on the plurality of signals;

determine if an online water wash, an offline water wash, or a combination thereof, should be executed; and if it is determined that the online water wash, the offline water wash, or the combination thereof, should be executed, then executing the online water wash, the offline water wash, or the combination thereof, wherein the online water wash comprises a low pressure compressor (LPC) online water wash, wherein the compressor efficiency comprises a low pressure compressor (LPC) adiabatic efficiency, wherein determining if the online water wash should be executed comprises comparing a LPC efficiency difference (LPCDIF) to a first range and comparing a heat range percentage (HRPCT) to a second range, and executing the online water wash comprises executing a LPC online water wash.

2. The control system of claim 1, wherein comparing the LPCDIF to the first range comprises determining if the LPCDIF is >0.01 and <=0.02 and wherein comparing the HRPCT to the second range comprises determining if the HRPCT>0.01 and <=0.02.

3. The control system of claim 1, comprising determining the LPCDIF by subtracting a current LPC efficiency from an addition comprising a deterioration percentage added to a LPC estimated efficiency, wherein the LPC estimated efficiency is derived by executing a statistical model of a fleet of gas turbine systems.

4. The control system of claim 1, wherein the online water wash further comprises a high pressure compressor (HPC) online water wash, wherein the compressor efficiency further comprises a high pressure compressor (HPC) adiabatic efficiency, wherein determining if the online water wash should be executed further comprises comparing a HPC efficiency difference (HPCDIF) to a first range and comparing a heat range percentage (HRPCT) to a second range, and executing the online water wash further comprises executing a HPC online water wash.

5. The control system of claim 1, wherein the offline water wash comprises a low pressure compressor (LPC) offline water wash, wherein determining if the offline water wash should be executed comprises comparing a LPC efficiency difference (LPCDIF) to a first range and comparing a heat range percentage (HRPCT) to a second range, and executing the offline water wash comprises executing a LPC offline water wash.

6. The control system of claim 5, wherein comparing the LPCDIF to the first range comprises determing if the LPCDIF is >0.02 and wherein comparing the HRPCT to the second range comprises determining if the HRPCT >0.02.

7. The control system of claim 1, wherein the offline water wash comprises a high pressure compressor (HPC) offline water wash, wherein the compressor efficiency further comprises a high pressure compressor (HPC) adiabatic efficiency, wherein determining if the offline water wash should be executed comprises comparing a HPC efficiency difference (HPCDIF) to a first range and comparing a heat range percentage (HRPCT) to a second range, and executing the offline water wash comprises executing a HPC offline water wash.

8. A non-transitory computer-readable medium having computer executable code stored thereon, the code comprising instructions to:

receive a plurality of signals from sensors disposed in a turbine system, wherein the turbine system comprises a compressor system, the compressor system comprising a low pressure compressor (LPC), a high pressure compressor (HPC), or a combination thereof;

derive a compressor efficiency and a turbine heat rate based on the plurality of signals;

determine if an online water wash, an offline water wash, or a combination thereof, should be executed; and if it is determined that the online water wash, the offline water wash, or the combination thereof, should be executed, then executing the online water wash, the offline water wash, or the combination thereof, wherein the online water wash comprises a low pressure compressor (LPC) online water wash, wherein the compressor efficiency comprises a low pressure compressor (LPC) adiabatic efficiency, wherein determining if the online water wash should be executed comprises comparing a LPC efficiency difference (LPCDIF) to a first range and comparing a heat range percentage (HRPCT) to a second range, and executing the online water wash comprises executing a LPC online water wash.

9. The non-transitory computer-readable medium of claim 8, comprising determining the LPCDIF by subtracting a current LPC efficiency from an addition comprising a deterioration percentage added to a LPC estimated efficiency, wherein the LPC estimated efficiency is derived by executing a statistical model of a fleet of gas turbine systems.

10. The non-transitory computer-readable medium of claim 8, wherein the online water wash further comprises a high pressure compressor (HPC) online water wash, wherein the compressor efficiency further comprises a high pressure compressor (HPC) adiabatic efficiency, wherein determining if the online water wash should be executed further comprises comparing a HPC efficiency difference (HPCDIF) to a first range and comparing a heat range percentage (HRPCT) to a second range, and executing the online water wash further comprises executing a HPC online water wash.

11. The non-transitory computer-readable medium of claim 8, wherein the offline water wash comprises a low pressure compressor (LPC) offline water wash, wherein determining if the offline water wash should be executed comprises comparing a LPC efficiency difference (LPCDIF) to a first range and comparing a beat range percentage (HRPCT) to a second range, and executing the offline water wash comprises executing a LPC offline water wash.

12. The non-transitory computer-readable medium of claim 8, wherein the offline water wash comprises a high pressure compressor (HPC) offline water wash, wherein the compressor efficiency further comprises a high pressure compressor (HPC) adiabatic efficiency, wherein determining if the offline water wash should be executed comprises comparing a HPC efficiency difference (HPCDIF) to a first range and comparing a heat range percentage (HRPCT) to a second range, and executing the offline water wash comprises executing a HPC offline water wash.

13. The non-transitory computer-readable medium of claim 8, comprising instructions configured to store a first set of data related to compressor efficiency before executing the online wash, the offline wash, or the combination thereof, and to store a second set of data related to compressor efficiency after executing the online wash, the offline wash, or the combination thereof.

14. A method for a gas turbine system, comprising:

receiving a plurality of signals from sensors disposed in a turbine system, wherein the turbine system comprises a compressor system, the compressor system comprising a low pressure compressor (LPC), a high pressure compressor (HPC), or a combination thereof;

deriving a compressor efficiency and a turbine heat rate based on the plurality of signals;

determining if an online water wash, an offline water wash, or a combination thereof, should be executed; and if it is determined that the online water wash, the offline water wash, or the combination thereof, should be executed, then executing the online water wash, the offline water wash, or the combination thereof, wherein the online water wash comprises a low pressure compressor (LPC) online water wash, wherein the compressor efficiency comprises a low pressure compressor (LPC) adiabatic efficiency, wherein determining if the online water wash should be executed comprises comparing a LPC efficiency difference (LPCDIF) to a first range and comparing a heat range percentage (HRPCT) to a second range, and executing the online water wash comprises executing a LPC online water wash.

15. The method of claim 14, wherein the online water wash further comprises a high pressure compressor (HPC) online water wash, wherein the compressor efficiency further comprises a high pressure compressor (HPC) adiabatic efficiency, wherein determining if the online water wash should be executed further comprises comparing a HPC efficiency difference (HPCDIF) to a first range and comparing a heat range percentage (HRPCT) to a second range, and executing the online water wash further comprises executing a HPC online water wash.

16. The method of claim 14, wherein the offline water wash comprises a low pressure compressor (LPC) offline water wash, wherein determining if the offline water wash should be executed comprises comparing a LPC efficiency difference (LPCDIF) to a first range and comparing a heat range percentage (HRPCT) to a second range, and executing the offline water wash comprises executing a LPC offline water wash.

17. The method of claim 14, wherein the offline water wash comprises a high pressure compressor (HPC) offline water wash, wherein the compressor efficiency further comprises a high pressure compressor (HPC) adiabatic efficiency, wherein determining if the offline water wash should be executed comprises comparing a HPC efficiency difference (HPCDIF) to a first range and comparing a heat range percentage (HRPCT) to a second range, and executing the offline water wash comprises executing a HPC offline water wash.

* * * * *